United States Patent [19]

Todisco

[11] Patent Number: 5,005,330

[45] Date of Patent: Apr. 9, 1991

[54] ASSEMBLY OF BATTENS PARTICULARLY FOR THE COVERING OF SLOPING ROOFS

[75] Inventor: Serge Todisco, Le Bourget, France

[73] Assignee: Societe Moderne d Batiment Industriel, Le Bourget, France

[21] Appl. No.: 396,358

[22] Filed: Aug. 21, 1989

[30] Foreign Application Priority Data

May 26, 1989 [FR] France ..... 89 06904

[51] Int. Cl.[5] ..... E04D 12/00

[52] U.S. Cl. ..... 52/303; 52/15; 52/410

[58] Field of Search ..... 52/748, 302, 303, 408, 52/410, 409, 15, 11

[56] References Cited

U.S. PATENT DOCUMENTS 2,885,743 5/1959 Macormack ..... 52/407

FOREIGN PATENT DOCUMENTS 0027750 4/1981 European Pat. Off. .
0230159 7/1987 European Pat. Off. .
1193658 4/1981 Fed. Rep. of Germany .
3209348 9/1983 Fed. Rep. of Germany .
3238861 5/1984 Fed. Rep. of Germany ..... 52/410
2206808 6/1974 France .

OTHER PUBLICATIONS

Kunststoffe, Carl Hauser Verlag, Munich (DE) Band 60, Heft 8 (1970), pp. 508-510, H. Wild: "Dachunterspann-folien aus Kunststoff": p. 509, colonne 2 —p. 510, ligne 10; FIGS. 11,12.

*Primary Examiner*—John E. Murtagh
*Attorney, Agent, or Firm*—Marvin E. Jacobs

[57] ABSTRACT

The invention concerns an assembly of roof battens which enables them to be stored in an assembled state and layed rapidly at the desired spacing on a receiving surface such as the rafters of a roof; a continuous flexible sheet is held in place by stapling strips onto the battens where they intersect with them, in such a way that, after the assembly of battens has been layed on the rafters, the continuous flexible sheet forms a deep central trough between two adjacent rafters to allow water to run off.

4 Claims, 1 Drawing Sheet

ASSEMBLY OF BATTENS PARTICULARLY FOR THE COVERING OF SLOPING ROOFS

TECHNICAL FIELD

The present invention relates to an assembly of battens which enables them to be stored and rapidly put in place, at the desired spacing, on elements constituting a receiving surface for the subsequent mounting of covering elements, and consisting of a series of parallel and regularly spaced battens attached to a continuous sheet formed from a flexible material, the battens being moreover mutually joined together by parallel, thin, flexible strips that are resistant and substantially inextensible, arranged transversely with respect to the axis of the battens and fixed to them where they intersect.

STATEMENT OF THE PRIOR ART

According to EP- A-0 230 159, assemblies of battens are known in which the battens are mutually joined together by parallel, thin, flexible strips that are resistant and substantially inextensible, arranged transversely with respect to the axis of the battens and fixed to them where they intersect, in such a manner that each batten is arranged between the sheet and the strips and is insulated by the sheet from the environment prevailing at the other side of the sheet.

Such assemblies of battens have proved to be suitable for rapid laying on a roof structure, but have turned out to be relatively expensive to produce since a double stapling operation is involved:

one for fixing the resistant strips and the other for the continuous flexible sheet in plastics material, which is relatively low in resistance and is designed to be torn off after the battens have been layed on the rafters, and just prior to laying the covering to allow normal ventilation of the roof.

Another envisaged function for such assemblies of battens, consisting in provisional weatherproofing of a building, and the prevention of leaks as a roof underlay, couldn't be achieved using assemblies of battens of this type.

The present invention has the aim of providing this additional function whilst at the same time reducing the manufacturing costs of such assemblies.

STATEMENT OF THE INVENTION

The present invention provides an assembly of battens in which the continuous sheet has a good tear-off and tear resistance and is inserted between the battens and the resistant parallel strips the spacing of which substantially corresponds to the spacing of the above-said elements constituting a receiving surface, in which the continuous sheet is held in place by stapling said strips onto the battens where they intersect with the latter, and in which the length of the flexible sheet between two adjacent resistant parallel strips is greater than the length of the battens separating these two adjacent strips and is adapted, when layed, to provide a trough or gutter.

According to one embodiment of the invention, the continuous flexible sheet includes perforations arranged in areas that are separate from the areas of said troughs or gutters.

According to a further embodiment of the invention, the continuous flexible sheet includes perforations the edges of which are raised in the direction of the battens.

The perforations can advantageously be replaced by microperforations provided at the outset in the flexible sheet, and which due to surface tension effects, oppose the flow of water whilst at the same time allowing air to pass through for ventilating the roof.

According to still a further embodiment of the invention, the transverse thin parallel strips are stapled at their intersection with at least each of the end battens in the assembly by making use of a plurality of staples. This enables the strength of stapling to be augmented on this first batten which will be subjected to tractional forces during the laying operation.

According to a method of carrying out the invention, the continuous flexible sheet extends beyond the set of battens and stapling of the parallel strips onto the battens is done using staples having diverging ends or staples that are bevelled outwardly, so that the staple penetrates deeply into the batten in the sense of the batten's length and parallel to the surface of the continuous flexible sheet, without extending through to the outside of said batten, and provides local clamping of the continuous flexible sheet by the resistant parallel strips.

According to a further method of carrying out the invention, the elements forming a receiving surface for the subsequent fixing of roofing elements consist of rafters and said fixing is achieved using nails that simultaneously pass through the continuous flexible sheet and the resistant strips.

This makes it possible, after laying the assembly of battens on the corresponding elements, for example rafters or pre-assembled roofing trusses placed on the line of greatest slope of the roof with the resistant parallel strips resting on the rafters, for the continuous flexible sheet to form a relatively deep central trough between two adjacent rafters for leading water off the roof, which defines a ventilation space for the roof and which is adapted to provide provisional waterproofing of the building and correction of leaks by acting as a roof underlay.

The aim of the present invention is also to provide a method for fixing an assembly of battens such as defined above onto a receiving surface, preferably a roof, in which, after laying the assembly of battens on the corresponding elements of the receiving surface, placed according to the line of greatest slope of the roof by resting the resistant parallel strips on the said elements, the continuous flexible sheet forms a relatively deep central trough between two adjacent rafters for leading water off the roof, which defines a ventilation space for the roof and which is adapted to provide provisional waterproofing of the building and recuperation of leaks by acting as a roof underlay.

According to a way of carrying out the method according to the invention, overlapping of the sheets of two assemblies layed side by side on the roof is established at the ends of the assemblies in the sense of the slope of the roof, and at the ridge of the roof at least, prior to laying the roof covering by folding the sheet over and the lower part of the sheet is given a curved shape to lead the water collected on the flexible sheet to means for collecting it.

Other aims, advantages and characteristics will become clear from reading the description which follows of one way of carrying out the invention, which is intended to be non-limiting, and with reference to the attached drawings in which:

DETAILED DESCRIPTION OF THE INVENTION

Figure 1:
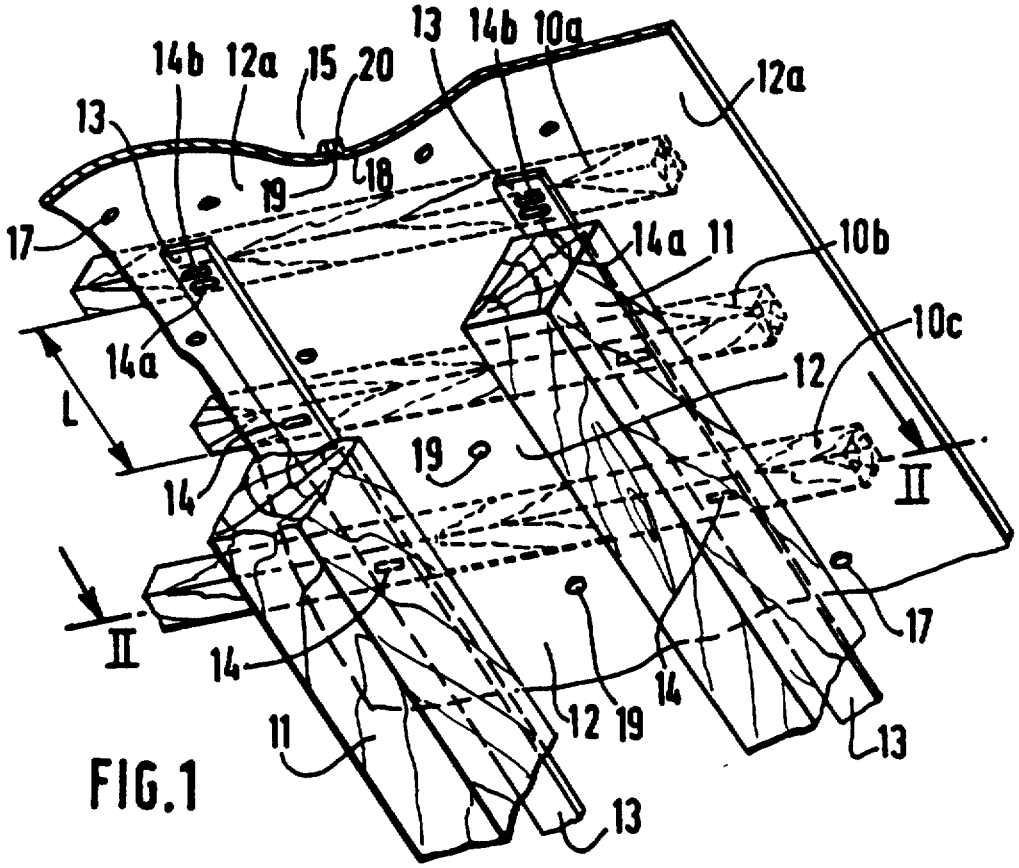
FIG. 1 is a partial view seen in perspective from below of the assembly of battens in accordance with the invention layed on the rafters of a roof, which have in part been cut away to show the structure of the assembly better.

The assembly of battens shown in FIG. 1 consists of a series of battens 10*a* 10*b*, 10*c* generally consisting of sawn but unplaned wood in common dimensions (generally comprised between 15×36 mm and 50×50 mm) and if possible free of knots in order to facilitate stapling by insertion under force, into the dry or partially green wood, of U-shaped staples of a preferred type that will be described later. The battens could be provided in another material suitable for stapling, such as a plastics material and/or an elastomer. The battens are arranged parallel and equidistantly with respect to each other at intervals indicated by L in order to be fixed onto the rafters 11 of a roof and are stapled by means of staples 14 onto one face of a continuous flexible sheet 12 in a resistant flexible material, for example in polyethylene or polyane. The battens are additionally mutually connected by flexible, thin, parallel and substantially inextensible strips 13 which are equidistant with respect to each other, extending transversely with respect to the axis of the battens, and are fixed by means of the staples 14 to each one of the battens whilst clamping the sheet 12, through which the staple 14 also passes, against the battens 10. The U-shaped staples 14 are preferably oriented with the bar of the U parallel to the axis of the battens in order to better support slightly off-true stapling.

It will be seen that the topmost batten 10*a* of the assembly is joined to the parallel strips 13 by stapling, using two staples 14*a* and 14*b* each time, in order to ensure a stronger attachment to this batten 10*a* which will be located at the top or at the bottom of the roof and will consequently be subjected to all the tractional forces involved in laying the assembly of battens which is achieved by pulling on the strips 13 from the lowermost batten after nailing the batten 10*a* at the top of the roof.

The sheet 12 which exhibits good tear-off or tear resistance from its fixing points on the battens 10 under the strips 13, is loosely mounted between two parallel strips 13 corresponding to two roof rafters 11. The length of continuous flexible sheet between two adjacent strips 13 is hence distinctly greater than the length of the battens 10, which are relatively rigid in the axial sense, separating the two adjacent strips. When the battens 10 are layed on the rafters 11, the strips 13 consequently come into contact with the rafters 11 and the flexible sheet 12 forms a central trough 15 (see FIG. 2) which is hollow and relatively deep and which is developed between the rafters 11 following the line of greatest slope of the roof.

The weight of water and other material exercised on the trough 15 is supported by the flexible sheet 12 being trapped between the thin strip 13 and the batten 10, the trapping effect being further augmented by the clamping provided by the nails 16 that fix the battens 10 onto the rafters 11. These nails pass locally through the sheet 12 and the strips 13 at different points and are driven into the rafters 11. The weight of the roofing elements (not shown and consisting of tiles, slates, etc.) placed on top of the battens further increases the trapping effect in service of the flexible sheet 12 between the batten 10 and the strips 13, and there is very little likelihood of the sheet 12 which is made of a resistant flexible material such as polyane or another synthetic material, notably a waterproof material that is porous to air to allow ventilation, tearing under the weight of water or the wind force to which it is subject.

In accordance with an arrangement providing for ventilation of the roof, perforations 17 are provided at a distance from the bottom 18 of the trough 15, preferably close to and in the region of the parallel strips 13. These perforations which can be provided at the time when the assembly is being produced by stapling the strips 13 onto the battens 10 ensure ventilation of the portion of the roof situated above the rafters 11.

In accordance with another embodiment of the ventilation means, the sheet 12 is provided, prior to its fastening onto the battens 10, with perforations 19 (made for example with a heated tip), the total area of the perforations being small with respect to the surface area of the sheet and each of them having a raised edge 20 which projects from the side of the sheet directed towards the outside at the time of laying, in other words on the batten side. After the battens have been unwound onto the sloping roof, rain, even heavy rain, is only able to penetrate in the form of occasional drops through the perforations 19, and runs around the sides of the raised edge 20. Even when such perforations 19 come to be situated at the bottom 18 of the trough 15, the water recovered from leaks when acting as an underlay (shown at 21) flows round the edge 20 and cannot flow through the perforation 19 except in the form of occasional drips because of their small cross-section which is nevertheless sufficient to allow ventilation through hot air inside passing through the perforations 19. Advantageously, pre-existing microperforations in the sheet 12 are employed rather than perforations 17 and 19, such microperforations opposing the percolation of water but allowing air for ventilation to pass.

As will be seen in FIG. 1, the continuous flexible sheet 12 easily extents beyond the set of battens 10, not only in the lateral sense in order to allow two assemblies placed side by side on a roof to overlap, but above all at the two ends of the assembly to be unrolled (see the upper extremity 12*a*). This excess sheet at the end 12*a* makes it possible to cover the ridge of the roof by folding over the excess sheet so that it comes against the other sloping side of the roof. After the battens have been layed, the ridge of the roof is thus covered with a provisional covering of two layers 12*a* of continuous flexible sheet which are superposed and each folded over onto the other sloping side of the roof. Prior to laying the covering, such as tiles, the folded over parts are generally cut off in order to provide a good ventilation air flow at the ridge of the roof. At the lower part of the assembly, the excess sheet (identical to sheet 12*a* but not shown) has the purpose of rejecting water which flows down the continuous flexible sheet to the outside when it is acting as a provisional covering and of draining off leaks that occur unintentionally when the continuous flexible sheet is acting as a roof underlay.

Figure 2:
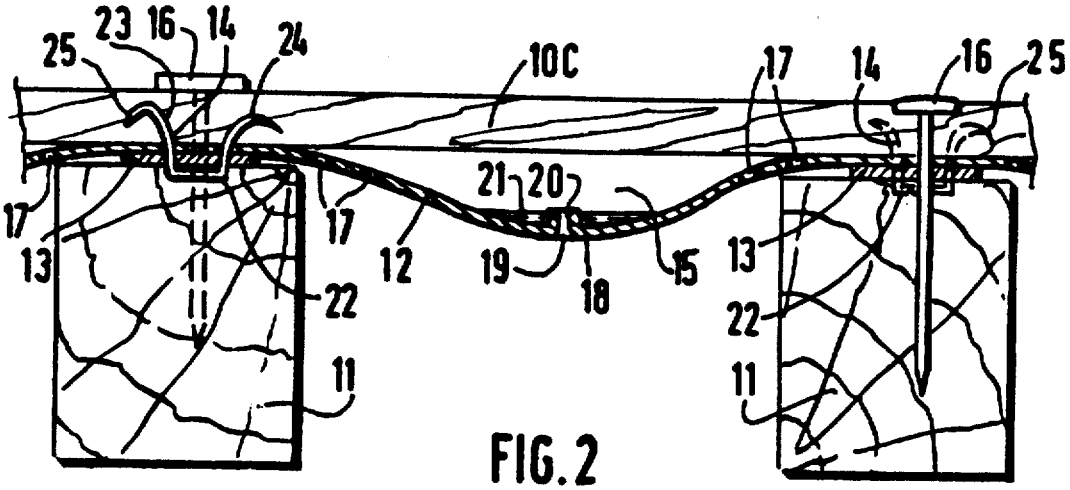
FIG. 2 is a sectional view along the line II-II of FIG. 1, of a part of the assembly of battens in accordance with the invention, layed on the receiving rafters.

In accordance with another embodiment of the assembly of battens more particularly represented in FIG. 2, the cross-bar 22 of the U-shaped staples 14 is continued by two pointed prongs 23, 24, the pointed face of which is bevelled off at 25 and points outwardly. With the staples 14 shaped in this manner, during the stapling operation with pressure exercised on the crossbar 22 of the U-shape, the staple's prongs penetrate into the wood or synthetic material constituting batten 10, and orient themselves, at least in part, parallel to the axis of the batten 10 and even turn back hookwise on themselves as shown at 23 and 24 in FIG. 2. When the battens have a small thickness (for example 15 mm for the thinnest battens), staple 14 nevertheless gets firmly anchored in the material forming the batten, and exerts a high force that persists with the passage of time on the flexible strip 13 thus indirectly clamping the flexible sheet 12 well, which opposes tearing of the flexible sheet when subject to tractional forces.

The assembly of battens in accordance with the invention is generally delivered and transported in the form of a roll that corresponds to the standard length of one side of a sloping roof. In order to lay it, after having nailed the upper batten 10*a* onto the rafters 11 or the equivalent preassembled trusses, the assembly is unwound on the roof down to the bottom where the last batten comes to lay, after slight traction on the whole assembly and lateral orientation, exactly at the intended position at the lower end of the standard sloping side of the roof. The first series of battens is aligned with the edge of the roof, and the second series of battens is layed at the side of the first series on the same rafter. It is possible, in the case where there is too great an offset, to simultaneously cut through the battens on both series, substantially in the middle of the rafter, whilst avoiding coming into contact with the flexible sheet 12. As can be seen in FIG. 2, the continuous flexible sheet 12 not only constitutes a wall for collecting and evacuating rain and other matter, but also, as initial insulation, a wall separating the inside environment from the outside environment with which the covering (tiles, slates, etc.) is permanently in contact, as is the assembly of battens in accordance with the invention, which thus participates, after it has been layed, not only in the weather proofing but also in the general insulation of the building.

Obviously, the invention isn't limited to the embodiments that have been described and shown, but may adopt numerous alternatives accessible to those skilled in the art without however departing from the spirit of the invention.

I claim:

1. An assembly of battens which enables them to be stored and rapidly put in place, at the desired spacing, on elements constituting a receiving surface for the subsequent mounting of covering elements, and consisting of a series of parallel and regularly spaced battens attached to a continuous sheet formed from a flexible material, the battens being moreover mutually joined together by parallel, thin, flexible strips that are resistant and substantially inextensible, arranged transversely with respect to the axis of said battens and fixed at their intersection therewith, the continuous sheet having a good tear-off and tear resistance and being inserted between the battens and the resistant parallel strips the spacing of which substantially corresponds to the spacing of the above said elements constituting a receiving surface, and the continuous sheet being held in place by stapling said strips onto the battens at their intersection therewith, wherein the length of the flexible sheet between two adjacent resistant parallel strips is greater than the length of the battens separating these two adjacent strips whereby the flexible sheet when laid, forms a trough or gutter for collection and drawing off any water falling thereon, and wherein the continuous flexible sheet includes perforations allowing air ventilation through the flexible sheet and which are disposed in regions of the sheet that are separate from the areas of said trough or gutter.

2. An assembly of battens in accordance with claim 1, wherein the perforation are constituted by microperforations suitable for stopping water passing through said perforation while allowing air to pass through the perforations for ventilation.

3. An assembly of battens in accordance of claim 1, wherein the transverse thin parallel strips are stapled at their intersection with at least each of the end battens in the assembly by making use of a plurality of staples.

4. An assembly of battens in accordance with claim 1, wherein stapling of the parallel strips onto the battens is done using staples having diverging ends or staples that are bevelled and curved outwardly, so that the staple penetrates deeply into the batten in the direction of the batten's length and parallel to the surface of the continuous flexible sheet, without extending through to the outside of said batten, whereby said stapling provide local clamping of the continuous flexible sheet by the resistant parallel strips.

* * * * *